United States Patent [19]

Jarrett

[11] 4,286,930

[45] Sep. 1, 1981

[54] FUEL INJECTION SYSTEMS

[75] Inventor: Boaz A. Jarrett, London, England

[73] Assignee: Lucas Industries Limited, Birmingham, England

[21] Appl. No.: 94,902

[22] Filed: Nov. 16, 1979

[30] Foreign Application Priority Data

May 11, 1979 [GB] United Kingdom ..... 16438/79

[51] Int. Cl.[3] ..... F04B 17/04

[52] U.S. Cl. ..... 417/416; 123/467; 417/502

[58] Field of Search ..... 417/416, 415, 399, 398, 417/499, 493, 494, 444, 520, 502; 123/467, 499; 141/128

[56] References Cited

U.S. PATENT DOCUMENTS 3,514,228 5/1970 Toyoda ..... 417/416
4,167,373 9/1979 Jarrett et al. ..... 417/399

FOREIGN PATENT DOCUMENTS 412522 6/1934 United Kingdom ..... 417/494

*Primary Examiner*—Carlton R. Croyle
*Assistant Examiner*—Edward Look

[57] ABSTRACT

A fuel injection system includes a pumping plunger which is actuated by an actuating means to displace fuel through a valve controlled outlet. In order to reduce the fuel pressure quickly at the end of the stroke of the plunger valve means is provided which opens due to continued movement of the pumping plunger after the stroke of the actuating means has been halted by a stop.

5 Claims, 1 Drawing Figure

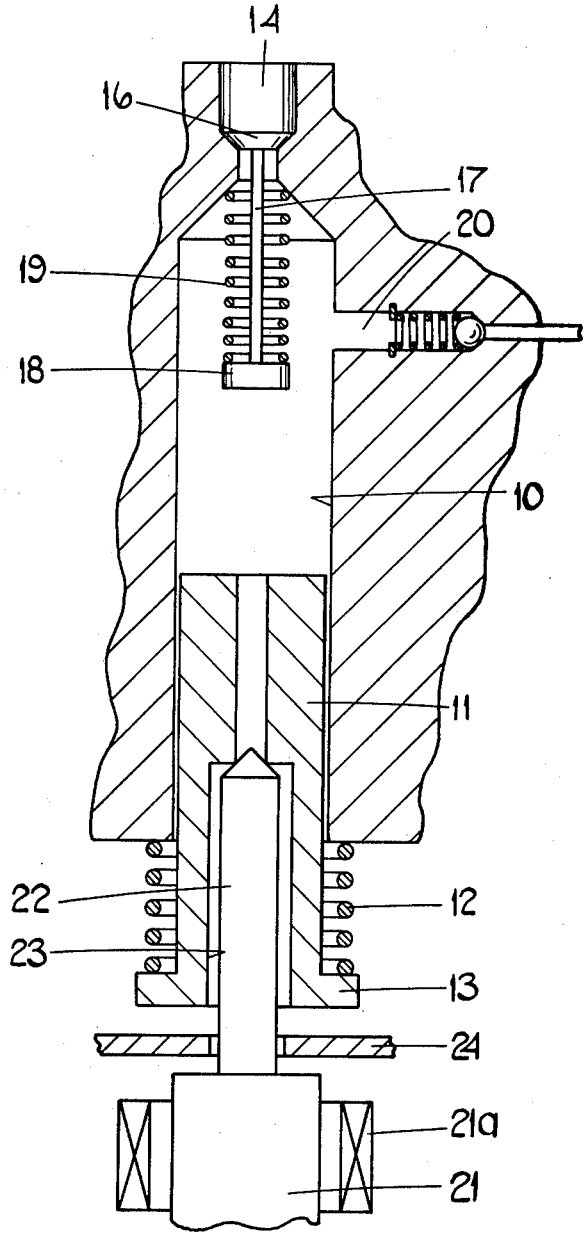
14
16
17
20
19
18
10
11
22
12
23
13
24
21a
21

FUEL INJECTION SYSTEMS

This invention relates to a fuel injection system of the kind comprising a pumping plunger slidable within a cylinder, actuating means for effecting movement of the pumping plunger in a direction to displace fuel from the cylinder and a fuel inlet to said cylinder through which fuel can flow into the cylinder during the return motion of the pumping plunger as permitted by movement of said actuating means.

Such a system in use will have the one end of the cylinder communicating with a fuel injection nozzle which embodies a pressure responsive valve. It is known that in order to avoid dribble from the nozzle at the end of the pumping stroke of the pumping plunger, the fuel pressure at the nozzle should be reduced as rapidly as possible in order that the valve member can close as quickly as possible.

It is an object of the present invention to provide a system of the kind specified in a form in which a rapid reduction in the pressure of fuel in the one end of the cylinder at the end of the pumping stroke of the pumping plunger is obtained.

According to the invention a system of the kind specified includes valve means defined by the plunger and actuating means, said valve means being maintained closed during movement of the pumping plunger by the actuating means, the system including a stop to limit the movement of the actuating means whereby in use, the pumping plunger will continue to move after the movement of the actuating means has been halted, so that said valve means will open to cause a reduction in the fuel pressure in said cylinder.

One example of a fuel injection system in accordance with the invention will now be described with reference to the accompanying diagrammatic drawings.

Referring to the drawings there is provided a cylinder 10 in which is located a pumping plunger 11. One end of the pumping plunger extends from one end of the cylinder and is provided at its end, with a flange 13 engaged by one end of a coiled compression spring 12. The other end of the coiled compression spring is engaged against a step defined by a body in which the cylinder 10 is formed. The other end of the cylinder communicates with an outlet 14 about which is defined a seating which is engageable by the head 16 of a valve member. The head 16 is connected to one end of a stem 17 the other end of which carries an abutment 18 engaged by a coiled compression spring 19. The spring 19 acts to urge the valve head into contact with the seating but the head can be lifted from the seating against the action of the spring 19 when the fuel pressure within the cylinder 10 rises to a predetermined value. The outlet, seating and valve member constitute a fuel injection nozzle.

Extending into the cylinder 10 is a valve controlled fuel inlet 20 which in use is connected to a source of fuel.

Movement of the plunger 11 is effected by means of an actuating means 21 which has an extension portion 22 extending within the larger portion of a stepped bore 23. The narrower end of the bore communicates with a pumping chamber defined by the cylinder and the plunger and the end of the extension portion 22 is shaped for co-operation with a seating which is defined about the narrower portion of the bore 23.

The extent of movement of the actuating means 21 is limited by a stop 24. The actuating means may for example comprise the armature of an electromagnetic device including a winding **21*a* which when energised, effects movement of the armature which movement is transmitted through the extension 22 to the plunger 11. The plunger 11 is therefore moved against the action of the spring 12 to pressurise the fuel in the aforesaid pumping chamber. When the fuel pressure rises to a sufficient value the valve head 16 is lifted from its seating to permit fuel flow through the outlet 14. The armature continues to move until it contacts the stop 24. The inertia of the plunger is however sufficient to cause further movement of the plunger and when this takes place relative movement occurs between the plunger and the extension to permit the high pressure fuel within the pumping chamber to flow out of the pumping chamber through the stepped bore 23. In this manner there will be a rapid reduction in the pressure of fuel within the pumping chamber such as will permit the valve head 16 to close quickly onto its seating. Thereby the risk of fuel dribbling from the outlet 14** is minimised.

When the winding of the electromagnetic means is de-energised, the spring 12 will effect movement of the plunger and also the armature towards the initial position and fuel will be drawn into the pumping chamber through the valve controlled inlet 20.

I claim:

1. A fuel injection system comprising a pumping plunger slidable within a cylinder, actuating an outlet from the cylinder and a non-return valve in said outlet, means for effecting movement of the pumping plunger in a direction to displace fuel from the cylinder through said outlet, a fuel inlet to the cylinder and through which fuel can flow into the cylinder during the return motion of the pumping plunger as permitted by movement of said actuating means, a non-return valve in said inlet, valve means defined by the plunger and actuating means, said valve means being maintained closed during movement of the pumping plunger by the actuating means, and the system including a stop to limit the movement of the actuating means whereby in use, the pumping plunger will continue to move after the movement of the actuating means has been halted, so that the valve means will open to cause a reduction in the fuel pressure in said cylinder.

2. A system according to claim 1 in which said valve means includes a seating on the plunger, said seating being located in a bore in the plunger, the actuating means including a portion shaped for co-operation with said seating, said portion being held in engagement with said seating when the plunger is being moved by the actuating means.

3. A system according to claim 2 in which said stop means comprises a plate having an aperture therein, said portion extending through said aperture.

4. A system according to claim 3 including resilient means biasing the plunger against the action of said actuating means.

5. A system according to claim 4 in which said actuating means comprises an electromagnetic device.

* * * * *